US008353064B2

(12) United States Patent
Tagatz

(10) Patent No.: US 8,353,064 B2
(45) Date of Patent: Jan. 15, 2013

(54) SALON CAPE WITH ADJUSTABLE MAGNETIC CHANNEL CLOSURE

(76) Inventor: Robert Tagatz, Oneida, WI (US)

( * ) Notice: Subject to any disclaimer, the term of this patent is extended or adjusted under 35 U.S.C. 154(b) by 212 days.

(21) Appl. No.: 12/797,178

(22) Filed: Jun. 9, 2010

(65) Prior Publication Data

US 2010/0306895 A1 Dec. 9, 2010

Related U.S. Application Data

(60) Provisional application No. 61/185,235, filed on Jun. 9, 2009.

(51) Int. Cl.
*A41D 13/04* (2006.01)

(52) U.S. Cl. ..... 2/50; 2/52; 24/303

(58) Field of Classification Search ..... 2/50, 52, 2/48, 46, 51, 88, 100, 138, 141.1, 141.2, 2/155, 156, 237, 311, 312, 321, 322, 319, 2/336, 338, 129; 24/303, 66.1, 68 R, 71 R, 24/302; 224/183

See application file for complete search history.

(56) References Cited

U.S. PATENT DOCUMENTS

| | | | | | |
|---|---|---|---|---|---|
| 1,615,352 | A | * | 1/1927 | Weiser et al. | 2/50 |
| 2,282,183 | A | * | 5/1942 | Harris | 2/50 |
| 2,379,722 | A | * | 7/1945 | Kase | 2/50 |
| 2,389,298 | A | * | 11/1945 | Ellis | 335/303 |
| 2,461,201 | A | * | 2/1949 | Ellis | 2/311 |
| 2,463,198 | A | * | 3/1949 | Pearce | 2/50 |
| 2,769,272 | A | * | 11/1956 | Goldman | 446/27 |
| 3,031,676 | A | * | 5/1962 | Larson | 2/50 |
| 4,463,455 | A | * | 8/1984 | Kirk | 2/338 |
| 4,472,839 | A | * | 9/1984 | Johansen | 2/338 |
| 5,079,777 | A | | 1/1992 | Fowler et al. | |
| 5,230,100 | A | | 7/1993 | Lock-Jones | |
| 5,307,582 | A | * | 5/1994 | Quintel | 40/633 |
| 5,309,575 | A | * | 5/1994 | Lookhoof | 2/322 |
| 5,572,740 | A | * | 11/1996 | Geniesse | 2/46 |
| D412,388 | S | | 8/1999 | Paolacci | |
| 5,953,753 | A | | 9/1999 | Perez | |
| 6,412,116 | B1 | | 7/2002 | Clark | |
| 6,496,985 | B1 | | 12/2002 | Faldet | |
| 6,868,554 | B1 | | 3/2005 | Melvin | |
| 7,788,735 | B1 | * | 9/2010 | Foulks | 2/50 |
| 7,827,622 | B2 | * | 11/2010 | Claro | 2/209.13 |
| 2003/0088902 | A1 | | 5/2003 | Levy | |
| 2004/0049828 | A1 | * | 3/2004 | Moses | 2/50 |
| 2004/0199973 | A1 | | 10/2004 | Moyal et al. | |
| 2005/0102802 | A1 | * | 5/2005 | Sitbon et al. | 24/303 |
| 2007/0039084 | A1 | | 2/2007 | Chard | |
| 2010/0205712 | A1 | * | 8/2010 | Bish | 2/50 |

* cited by examiner

*Primary Examiner* — Amy Vanatta

(57) ABSTRACT

The present invention is an adjustable magnetic channel closure for a salon cape. The channel closure has a reinforced tab located at or near each of the ends of the channel. Each reinforced tab has a pair of magnetic components that grip the channel when the reinforced tab is bent. The channel closure is tightened by pulling a gripping component located at each end of the channel closure. A cord located at the top of the channel prevents the reinforced tabs and magnetic components from sliding off the channel when the gripping components are pulled.

20 Claims, 5 Drawing Sheets

SALON CAPE WITH ADJUSTABLE MAGNETIC CHANNEL CLOSURE

CROSS-REFERENCE TO RELATED APPLICATIONS

This application claims priority to U.S. Provisional Application No. 61/185,235 filed on Jun. 9, 2009.

FIELD OF INVENTION

The present invention relates to the field of apparel and more specifically to a salon cape with an adjustable magnetic channel closure.

GLOSSARY

Figure 1:
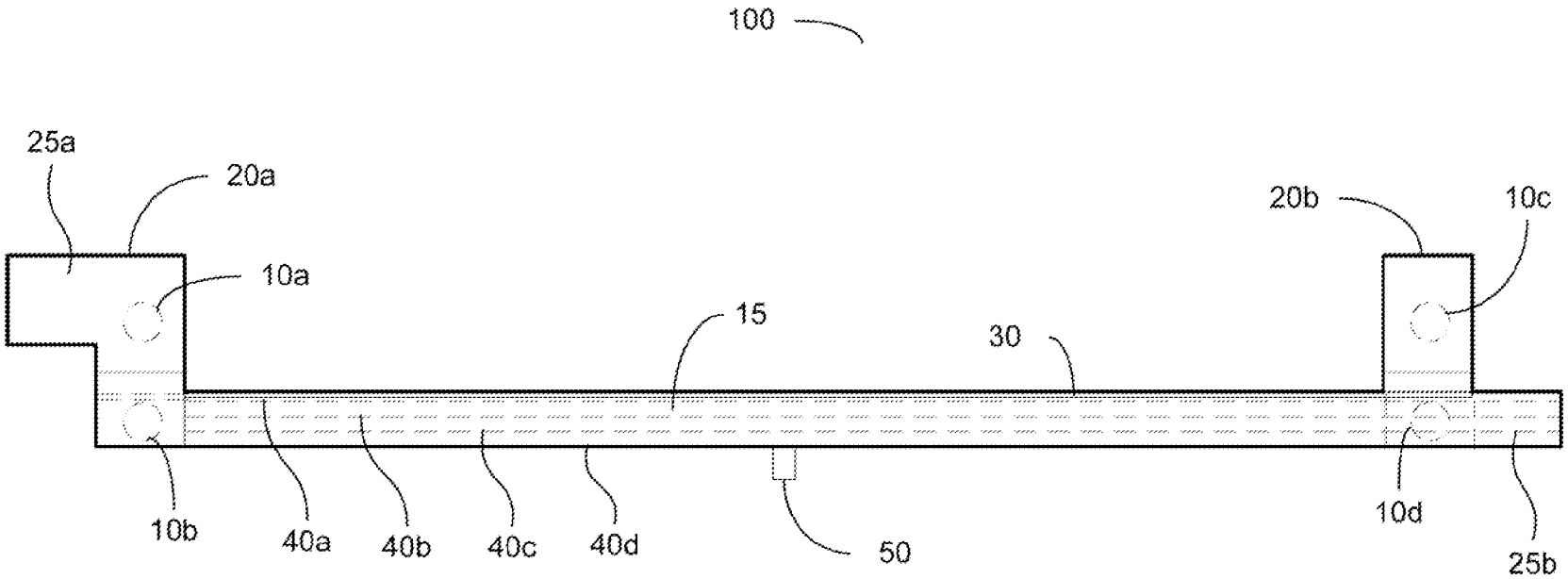
FIG. 1 illustrates a front view of an exemplary embodiment of an adjustable magnetic channel closure for a salon cape.

As used herein, the term "channel" refers to the elongated portion of an adjustable magnetic channel closure that encircles the wearer's neck.

As used herein, the term "channel cord" refers to the part of a channel that prevents reinforced tabs from sliding off of the channel when secured.

As used herein, the term "gripping component" refers to the components of an adjustable magnetic channel closure that are pulled to tighten the channel around an individual's neck.

As used herein, the term "reinforced tab" refers to a component of an adjustable magnetic channel closure that contains magnetic components, which grip the channel when reinforced tab is folded over.

As used herein, the term "position indicator tab" refers to a component that marks the part of an adjustable magnetic channel closure that should be centered on the front of an individual's neck when adjustable magnetic channel closure is secured around an individual's neck.

BACKGROUND

Salon capes are used in salons and barber shops to keep hair clippings, liquids, and chemicals from reaching the individual's skin or clothing. A typical salon cape is rectangular and has a circular cut-out near one end for the attachment of a neckline, which is used to fasten the cape around an individual's neck so that the cape drapes around the individual's body.

There are many types of neckline closures for salon capes known in the art. Fastening mechanisms, such as hook-and-loop fabric or snaps are commonly used for neckline closures. U.S. patent application Ser. No. 11/008,011 (Levy '011) teaches a salon cape that has a plurality of snaps spaced along the neck portion of the cape which allow the size of the neck opening to be adjusted to fit individuals with varying neck sizes. The available sizing, however, is predetermined by the placement of the snaps and often results in a size that is too loose or uncomfortably tight.

Levy '011 also teaches a second embodiment of a salon cape that uses strips of hook-and-loop fabric to secure the neckline around an individual's neck. While hook-and-loop fabric allows for more adjustability, it can irritate the individual's neck and hair may become lodged in the hook-and-loop fabric making the cape unsanitary. In addition, when washed, the hook-and-loop fabric collects hair, thread and other particles that must be picked out for the hook-and-loop fabric to function properly.

The use of a magnetic closure is also known in the art. U.S. Pat. No. 6,412,116 (Clark '116) teaches a cape with pockets formed in each end of the collar. In the preferred embodiment, a strip containing a plurality of disk magnets encapsulated in a silicone band is inserted into each pocket. Similar to snaps, the available sizes are determined by the placement of the disc magnets in the strip. In a second embodiment, Clark '116 teaches the use of a strip that has magnetic particles incorporated in the material. The strips have a width of less than 1 inch and when secured together around the individual's neck become somewhat rigid, which may be uncomfortable.

A typical salon cape is designed in the shape of a square or rectangle. A circular cut-out is made near one end of the rectangle for the attachment of a neckline. When these capes are draped over an individual's shoulders, they are longer in the front and shorter in the back. The draping places a seam along the individual's back. The stylist may snag the seam with the comb while combing mid-length or long hair or accidentally cut the seam and cape with scissors or shears.

It is desirable to have a closure mechanism that is adjustable to comfortably fit a variety of neck sizes.

It is desirable to have a neck closure that may be repeatedly laundered and dried without affecting the fastening capability of the closure.

It is desirable to have a salon cape that does not have a seam that runs along the individual's back when draped.

SUMMARY OF THE INVENTION

The present invention is an adjustable magnetic channel closure for a salon cape. The channel closure has a reinforced tab located at or near each end of the channel. Each reinforced tab has a set of magnetic components. Located at each end of the channel closure is a gripping component. The channel closure is secured to a salon cape and positioned in front of individual so that the position indicator tab is horizontally centered on the individual's neck. One side of the cape is draped over the individual's shoulder and the reinforced tab is folded so that the channel is gripped between the magnetic components. The second end of the channel is draped over the individual's other shoulder and the reinforced tab is folded so that the channel is gripped between the magnetic components. The gripping components are then pulled, tightening the channel closure until it is cinched gently around the individual's neck. A cord located at the top of the channel prevents reinforced tabs and magnetic components from sliding off the channel.

DETAILED DESCRIPTION OF INVENTION

For the purpose of promoting an understanding of the present invention, references are made in the text to exemplary embodiments of an adjustable magnetic channel closure for a salon cape, only some of which are described herein. It should be understood that no limitations on the scope of the invention are intended by describing these exemplary embodiments. One of ordinary skill in the art will readily appreciate that alternate but functionally equivalent materials, shapes, and dimensions may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates a front view of an exemplary embodiment of adjustable magnetic channel closure 100 for a salon cape. Adjustable magnetic channel closure 100 is comprised of channel 15, channel cord 30, reinforced tabs 20*a* and 20*b*, gripping components 25*a* and 25*b*, and position indicator tab 50.

In the embodiment shown, channel 15 has channel seams 40*a*, 40*b*, 40*c*, and 40*d*. Channel cord 30 is positioned at the top edge of channel 15 and is held in place by channel seam 40*a*. Channel seam 40*d* secures adjustable magnetic channel closure 100 to the top edge of salon cape 200 (not shown), and channel seams 40*b* and 40*c* stabilize adjustable magnetic channel closure 100 and improve the sliding of reinforced tabs 20*a* and 20*b* and magnetic components 10*a*, 10*b*, 10*c* and 10*d*. In addition, channel seams 40*b* and 40*c* increase the comfort of the individual wearing salon cape 200.

Reinforced tab 20*a* is secured to the first end of channel 15. Reinforced tab 20*a* has magnetic components 10*a* and 10*b* and further includes gripping component 25*a* which protrudes outward from the top half of reinforced tab 20*a*. In the embodiment shown, reinforced tab 20*a* is L-shaped with a height of approximately 2.156 inches, a bottom length of approximately 1 inch and a top length of approximately 1.5 inches so that gripping component 25*a* extends out approximately 0.5 inches. In other embodiments, gripping component 25*a* may be shortened or lengthened.

Reinforced tab 20*b* is secured near the second edge of channel 15 and contains magnetic components 10*c* and 10*d*. Gripping component 25*b* is the portion of channel 15 that extends beyond reinforced tab 20*b*. In the embodiment shown, reinforced tab 20*b* is rectangular with height of approximately 2.156 inches and a length of approximately 1 inch. In the embodiment shown, gripping component 25*b* has a length of approximately 1 inch; however, in other embodiments may be shorter or longer.

In the embodiment shown, channel 15 has a length of approximately 27 inches making the length of adjustable magnetic channel closure 100 approximately 30.5 inches.

In the embodiment shown, reinforced tabs 20*a* and 20*b* are comprised of low-density polyethylene (LDPE) and are injection molded around magnetic components 10*a* and 10*b* (reinforced tab 20*a*) and magnetic components 10*c* and 10*d* (reinforced tab 20*b*). Reinforced tabs 20*a* and 20*b* are approximately 1/64 inch thick and are flexible, which allows reinforced tabs 20*a* and 20*b* to be folded over to connect magnetic components 10*a* and 10*b* and magnetic components 10*c* and 10*d*. In other embodiments, reinforced tabs 20*a* and 20*b* are comprised of a material other than LDPE, such as high-density polyethylene, polyvinyl chloride (PVC), silicone, rubber, or any other material that is flexible and into which magnetic components can be secured.

Magnetic components 10*a*, 10*b*, 10*c* and 10*d* are positioned so that magnetic component 10*a* aligns with magnetic component 10*b* when reinforced tab 20*a* is folded and magnetic component 10*c* aligns with magnetic component 10*d* when reinforced tab 20*b* is folded.

In the embodiment shown, magnetic components 10*a*, 10*b*, 10*c* and 10*d* are nickel-plated neodymium magnets (Grade 33H) that have a diameter of approximately 0.465 inches and a thickness of approximately 0.115 inches. In other embodiments, magnetic components 10*a*, 10*b*, 10*c* and 10*d* are comprised of another material including, but not limited to sintered neodymium-iron-boron, aluminum-nickel-cobalt, samarium cobalt, and ferrite. The diameter and thickness of magnetic components 10*a*, 10*b*, 10*c* and 10*d* may also vary.

In the embodiment shown, channel cord 30 is comprised of silicone and has a diameter of approximately 0.125 inches. Channel cord 30 is high and low temperature resistant allowing adjustable magnetic channel closure 100 to be washed and dried in commercial washers and dryers. In other embodiments, channel cord 30 may have a smaller or larger diameter and may be comprised of a flexible, temperature resistant material including, but not limited to fluorosilicone, neoprene, Hypalon™, EPDM rubber, Viton™, and fabric. In various other embodiments, channel cord 30 is a shape other than circular (e.g., oval, square) and/or is attached to the exterior of channel 15.

In an exemplary embodiment, channel 15 and gripping component 25*b* are comprised of a nylon fabric and reinforced tabs 20*a* and 20*b* are encased in nylon fabric making adjustable magnetic channel closure 100 water-resistant. In other embodiments, another type of water-resistant or water-repellent fabric is used, including but not limited to soft PVC, satin, polyester, and Gore-Tex™.

Position indicator tab 50 designates the part of adjustable magnetic channel closure 100 that should be placed at the center of the front of an individual's neck. In the embodiment shown, position indicator tab 50 is located approximately half way between reinforced tabs 20*a* and 20*b* and extends approximately 0.75 inches below channel 15. In the embodiment shown, position indicator tab 50 is a loop of satin ribbon and is of a color that is distinct from the color of the nylon fabric. In various embodiments, position indicator 50 may be comprised of another type of material, be of varying shapes and sizes, or be a marking on the backside on channel 15.

Figure 2:
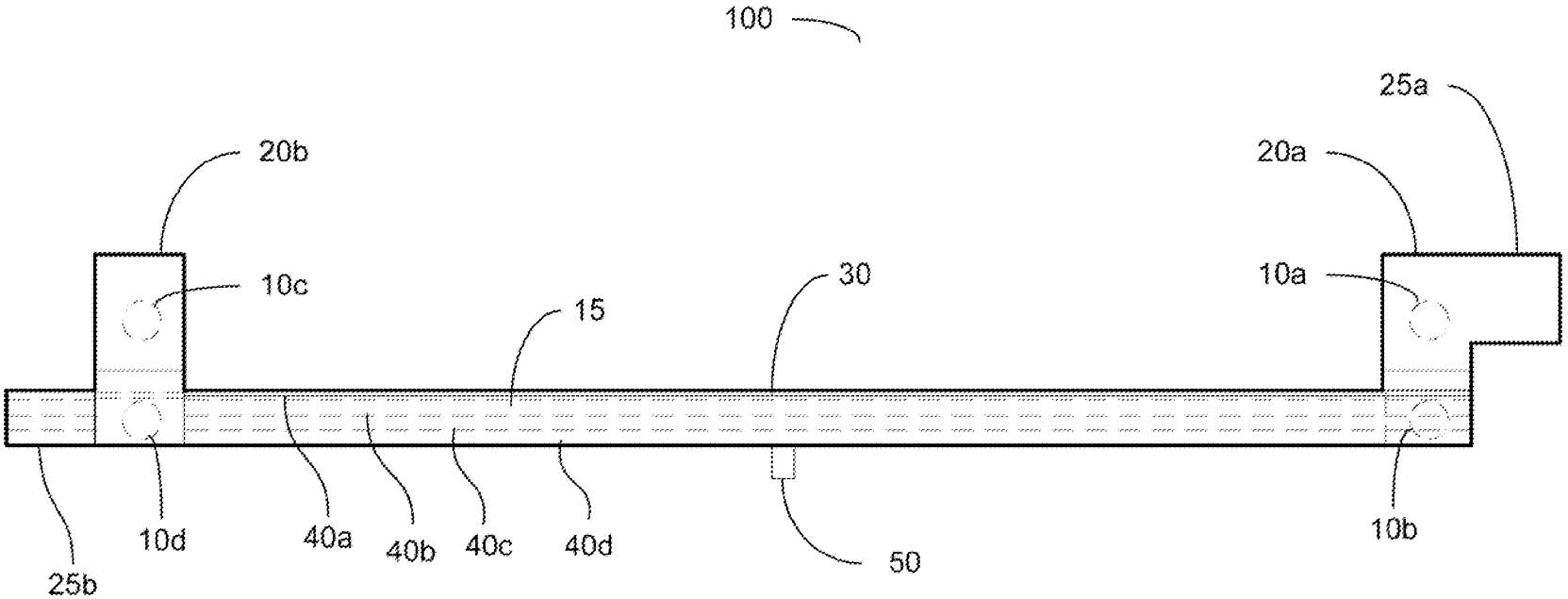
FIG. 2 illustrates a back view of an exemplary embodiment of an adjustable magnetic channel closure for a salon cape.

FIG. 2 illustrates a back view of an exemplary embodiment of adjustable magnetic channel closure 100 for a salon cape. Visible are channel 15, channel cord 30, channel seams 40*a*, 40*b*, 40*c* and 40*d*, reinforced tabs 20*a* and 20*b*, gripping component 25*a* and 25*b*, magnetic components 10*a*, 10*b*, 10*c* and 10*d*, and position indicator tab 50.

Figure 3:
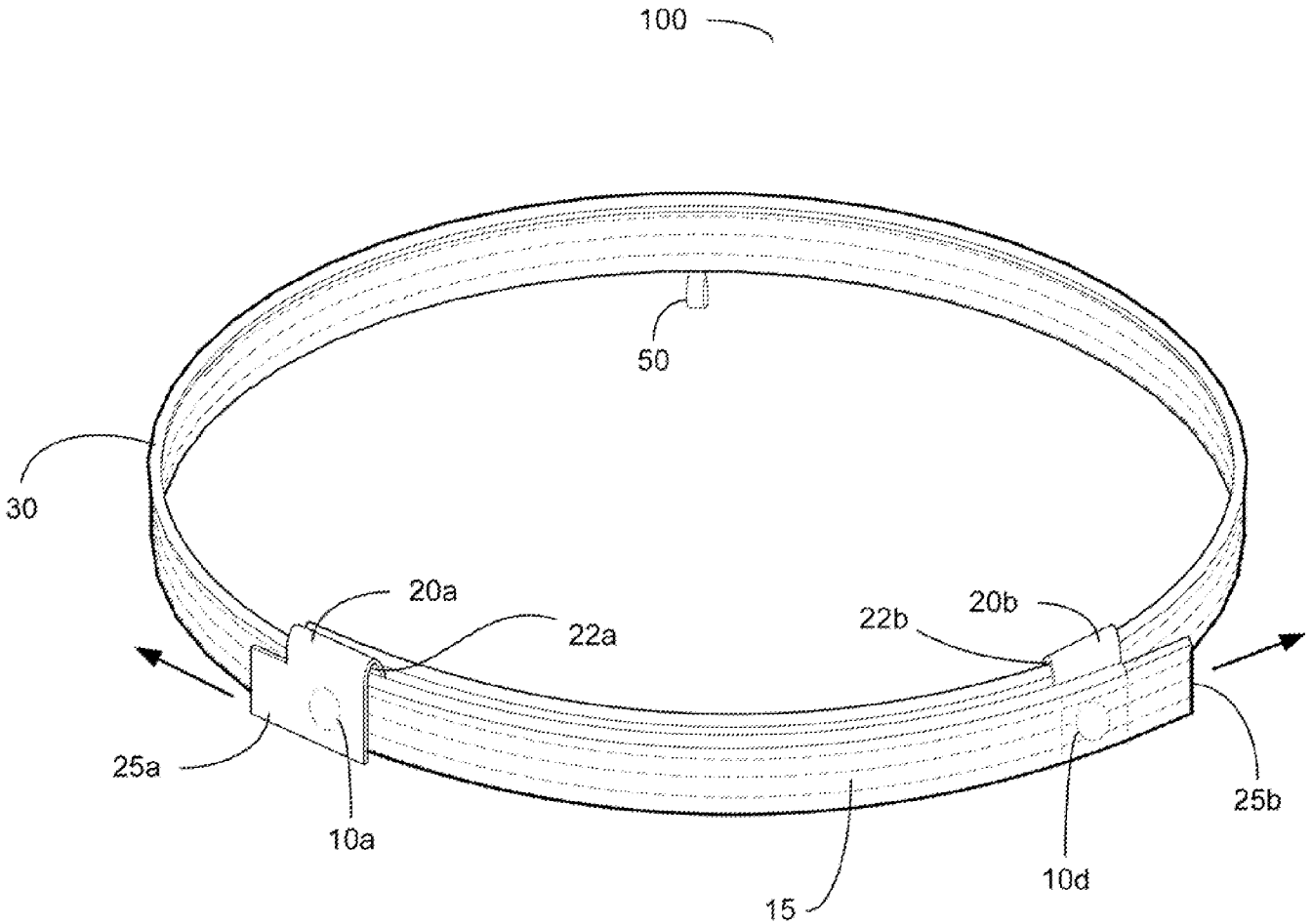
FIG. 3 illustrates a perspective view of an exemplary embodiment of an adjustable magnetic channel closure for a salon cape in use.

FIG. 3 illustrates a perspective view of an exemplary embodiment of adjustable magnetic channel closure 100 in use. To secure adjustable magnetic channel closure 100 around an individual's neck, adjustable magnetic channel closure 100 is placed so that position indicator tab 50 is positioned at the center of the front of the individual's neck. Reinforced tab 20*a* is brought around the individual's neck and the portion of reinforced tab 20*a* with magnetic component 10*b* is placed between channel 15 and the individual's neck. Reinforced tab 20*a* is then folded so that channel 15 is secured between magnetic components 10*a* and 10*b* creating an overlapping collar around the individual's neck.

Once reinforced tab 20*a* is secured, reinforced tab 20*b* is pulled and positioned so that magnetic component 10*d* is lined up with channel 15. Reinforced tab 20*b* is then folded so that channel 15 is secured between magnetic components 10*c* and 10*d* so that the portion of reinforced tab 20*b* with magnetic component 10*c* rests against the individual's neck. When both reinforced tabs 20*a* and 20*b* are secured, gripping components 25*a* and 25*b* are pulled until adjustable magnetic channel closure 100 is gently cinched around the individual's neck. Reinforced tabs 20*a* and 20*b* remain folded and secured until magnetic components 10*a* and 10*b* and magnetic components 10*c* and 10*d* are pulled apart.

Channel cord 30 rests in fold 22*a* of reinforced tab 20*a* and fold 22*b* of reinforced tab 20*b* when reinforced tabs 20*a* and 20*b* are secured. Channel cord 30 prevents reinforced tabs 20*a* and 20*b* from sliding off channel 15 when gripping components 25*a* and 25*b* are being pulled to tighten adjustable magnetic channel closure 100.

In the embodiment shown, channel 15 has a length of approximately 27 inches and can be adjusted for an exact fit for necks with a circumference of 12 to 24 inches. In other embodiments, channel 15 may be shorter or longer to accommodate varying sizes of necks. For example, channel 15 may range from 12 to 36 inches.

Figure 4:
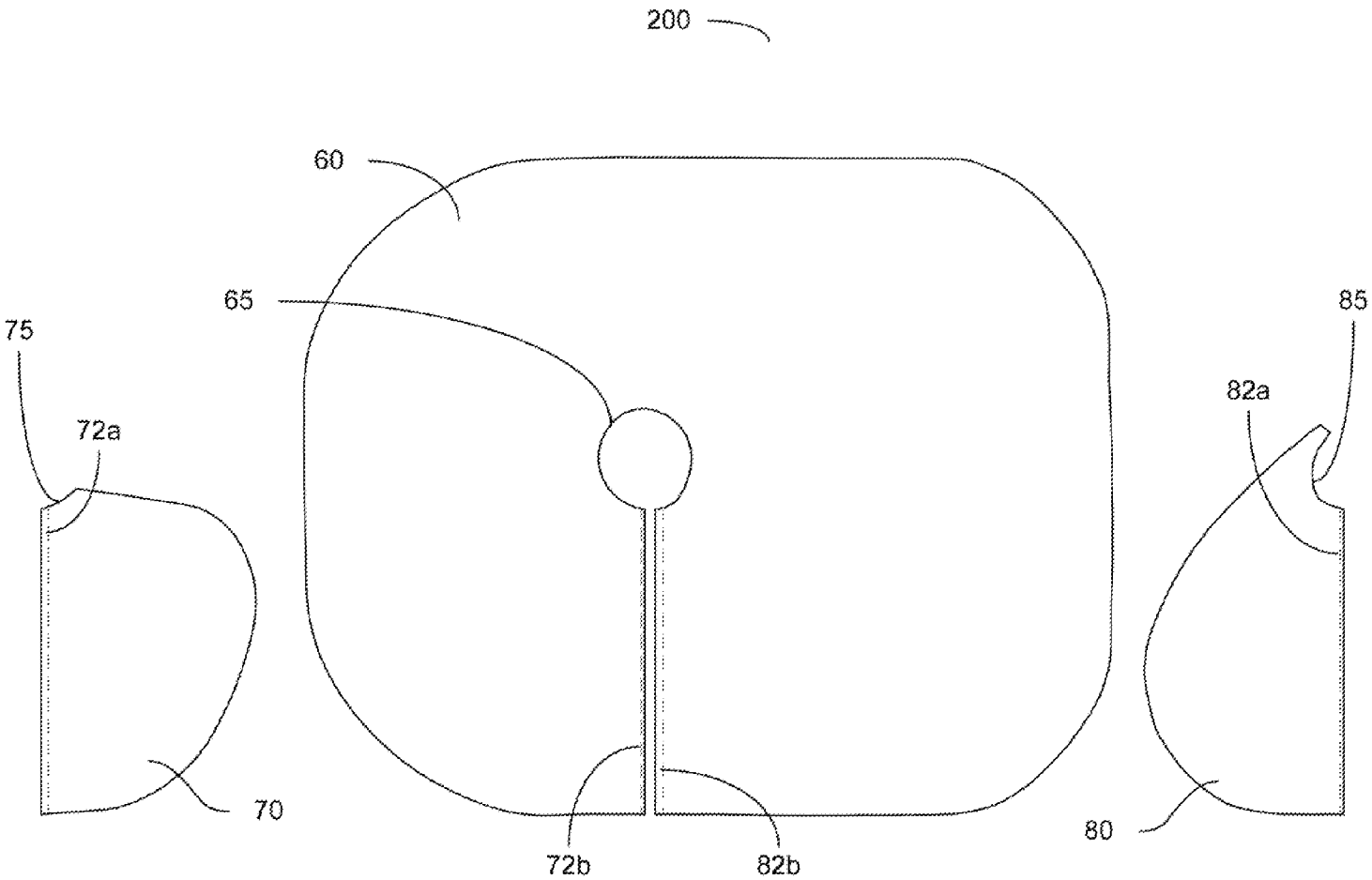
FIG. 4 illustrates a top view of the fabric pieces of an exemplary embodiment of a salon cape.

FIG. 4 illustrates a top view of an exemplary embodiment of salon cape 200 comprised of main body 60, first flap 70, and second flap 80. Seam 72*a* of first flap 70 is attached to main body 60 along seam 72*b*. Seam 82*a* of second flap 80 is attached to main body 60 along seam 82*b*. A hole is cut near the center of main body 60 creating neckline 65. First flap 70 further includes neckline 75 and second flap further includes neckline 85.

In the embodiment shown, first flap 70 and second flap 80 are sewn to main body 60; however, in other embodiments, first flap 70 and second flap 80 may be attached to main body 60 using other methods including, but not limited to fabric adhesive, snaps, zippers, ties, and rivets.

In the embodiment shown, main body 60, first flap 70, and second flap 80 are comprised of a nylon fabric that is water-resistant, anti-microbial, anti-static and chemical resistant. In other embodiments, another type of water-resistant or water-repellent fabric is used, including but not limited to soft PVC, satin, polyester, and Gore-Tex™.

In the embodiment shown, main body 60 is substantially oval-shaped with a length of approximately 68 inches and a width of approximately 56 inches. In the embodiment shown, the hole for neckline 65 is approximately centered widthwise, but is not centered lengthwise. The hole for neckline 65 is located approximately 25 inches from the left edge of main body 60 and approximately 39 to 40 inches from the right edge of main body 60. The hole for neckline 65 is located approximately 26 inches from the top edge of main body 60 and approximately 26 inches from the bottom edge of main body 60.

In the embodiment shown, first flap 70 and second flap 80 have lengths of approximately 17 inches and seams 72*a*, 82*b* are approximately 26 inches long to correspond to the length of seams 72*b*, 82*b* of main body 60. In other embodiments, the length and seam length of first flap 70 and second flap 80 vary with the dimensions of main body 60.

Figure 5:
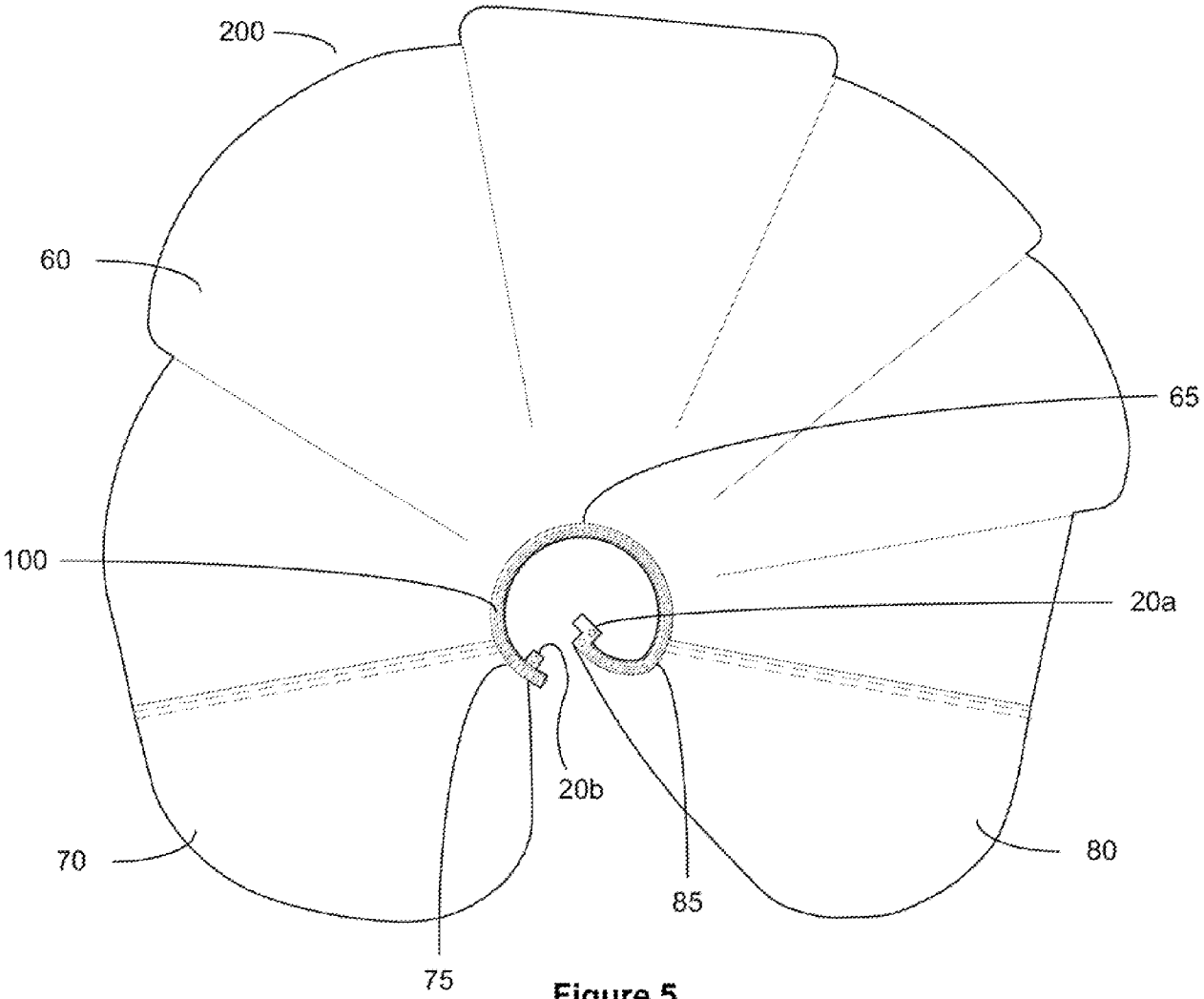
FIG. 5 illustrates a top view of an exemplary embodiment of a salon cape with an adjustable magnetic channel closure.

FIG. 5 illustrates a top view of an exemplary embodiment of salon cape 200 with adjustable magnetic channel closure 100. Adjustable magnetic channel closure 100 is attached to salon cape 200 along necklines 65, 75 and 85 of main body 60, first flap 70 and second flap 80, respectively.

To secure salon cape 200 around an individual, second flap 80 is draped around the individual's right shoulder and reinforced tab 20*a* is secured, first flap is then draped around the individual's left shoulder, overlapping first flap 80, and reinforced tab 20*b* is secured, resulting in a draping seam that is in front of the individual.

In the embodiment shown, the shape of salon cape 200 results in a draped cape that is relatively all one length (but may be slightly shorter in the back and longer in the front). The back of salon cape 200 is long enough to remain draped over the back of a salon chair preventing hair and liquids from coming in contact with the individual's clothes even when the individual leans forward. In addition, the shape and length of salon cape 200 allows the individual wearing it to move around more freely.

In various other embodiments, adjustable magnetic channel closure 100 may be attached to an article other than a salon cape.

What is claimed is:

1. An adjustable magnetic channel closure apparatus comprised of:

a channel having a first end and a second end;

a channel cord located at a top edge of said channel;

a channel seam which holds said channel cord in place;

a first reinforced tab with two magnetic components and a first gripping component; wherein said first reinforced tab is located at said first end of said channel and is positioned so that said first gripping component extends away from said channel;

a second reinforced tab with two magnetic components; wherein said second reinforced tab is located near said second end of said channel; and a second gripping component located at said second end of said channel.

2. The apparatus of claim 1 which further includes a position indicator tab.

3. The apparatus of claim 1 wherein said channel cord is a silicone cord.

4. The apparatus of claim 1 wherein said first reinforced tab and said second reinforced tab are comprised of low-density polyethylene.

5. The apparatus of claim 1 wherein said channel has a length of 27 inches and said apparatus is adjustable to fit necks with a circumference ranging from 12 to 24 inches.

6. The apparatus of claim 1 which further includes at least one additional channel seam.

7. A salon cape with an adjustable magnetic channel closure apparatus comprised of:

a main body having a first seam, a second seam, and hole that forms a neckline;

a first flap having a neckline, said first flap is attached to said first seam of said main body;

a second flap having a neckline, said second flap is attached to said second seam of said main body; and an adjustable magnetic channel closure apparatus comprised of:

a channel having a first end and a second end;

a channel cord that is inserted in a top edge of said channel;

a channel seam which holds said cord in place;

a first reinforced tab with two magnetic components and a first gripping component; wherein said first reinforced tab is located at said first end of said channel and is positioned so that said first gripping component extends away from said channel;

a second reinforced tab with two magnetic components; wherein said second reinforced tab is located near said second end of said channel;

a second gripping component located at said second end of said channel; and a position indicator tab;

wherein said adjustable magnetic channel closure apparatus is attached along said neckline of said first flap, said neckline of said main body, and said neckline of said second flap.

8. The salon cape of claim 7 wherein said channel cord is a silicone cord.

9. The salon cape of claim 7 which further includes two additional channel seams.

10. The salon cape of claim 7 wherein said first reinforced tab and said second reinforced tab are comprised of low-density polyethylene.

11. The salon cape of claim 7 wherein said channel has a length of 27 inches and said apparatus is adjustable to fit necks with a circumference ranging from 12 to 24 inches.

12. The salon cape of claim 7 wherein said main body, said first flap, and said second flap are comprised of nylon.

13. The salon cape of claim 7 wherein said main body has a length of 68 inches and a width of 56 inches.

14. The salon cape of claim 7 wherein said hole is centered widthwise and is off-centered lengthwise.

15. The salon cape of claim 7 wherein said first seam and said second seam have a length of 26 inches.

16. The salon cape of claim 7 wherein said first flap and said second flap have a length of 17 inches.

17. A method for draping a salon cape with an adjustable magnetic channel closure apparatus around an individual comprised of:

positioning said salon cape so that a position indicator tab on said apparatus is horizontally centered on said individual's neck;

draping a first end of said salon cape around said individual's right shoulder and placing a first reinforced tab having a first magnetic component and a second magnetic component so that said second magnetic component is between a channel of said apparatus and said individual's neck;

folding said first reinforced tab over so that said first magnetic component contacts said second magnetic component cinching said channel between said first magnetic component and said second magnetic component;

draping a second end of said salon cape around said individual's left shoulder and placing a second reinforced tab having a first magnetic component and a second magnetic component so that said second magnet component rests against said channel;

folding said second reinforced tab over so that said first magnetic component contacts said second magnetic component cinching said channel between said first magnetic component and said second magnetic component;

pulling a first gripping component on said first reinforced tab and a second gripping component adjacent to said second reinforced tab in opposite directions to tighten said apparatus until it is gently cinched around said individual's neck.

18. The method of claim 17 wherein said position indicator tab is a ribbon.

19. The method of claim 17 wherein said channel further includes a channel cord which prevents said first reinforced tab and said second reinforced tab from sliding off said channel when said first gripping and said second gripping component are pulled.

20. The method of claim 17 wherein said channel has a length of 27 inches and said apparatus is adjustable to fit necks with a circumference ranging from 12 to 24 inches.

* * * * *